US006803550B2

(12) United States Patent
Sharpe et al.

(10) Patent No.: US 6,803,550 B2
(45) Date of Patent: Oct. 12, 2004

(54) INDUCTIVE CLEANING SYSTEM FOR REMOVING CONDENSATES FROM ELECTRONIC SMOKING SYSTEMS

(75) Inventors: David E Sharpe, Chester, VA (US); Douglas A Burton, Glen Allen, VA (US); Patrick H. Hayes, Chester, VA (US); Jimmy Crowe, Chester, VA (US); Constance H. Morgan, Richmond, VA (US); John M. Adams, Mechanicsville, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 10/354,011

(22) Filed: Jan. 30, 2003

(65) Prior Publication Data

US 2004/0149737 A1 Aug. 5, 2004

(51) Int. Cl.[7] ..... H05B 6/10
(52) U.S. Cl. ..... 219/635; 219/263
(58) Field of Search ..... 219/635, 260, 219/263, 535, 539, 553; 131/243, 244, 329, 330, 182, 194, 334, 351, 360; 392/314; 128/202.21, 203.17, 203.27, 200.14

(56) References Cited

U.S. PATENT DOCUMENTS 5,179,966 A 1/1993 Losee et al.
5,222,185 A 6/1993 McCord, Jr.
5,249,586 A 10/1993 Morgan et al.
5,269,327 A 12/1993 Counts et al.
5,388,594 A 2/1995 Counts et al.
5,505,214 A 4/1996 Collins et al.
5,530,225 A 6/1996 Hajaligol
5,591,368 A 1/1997 Fleischhauer et al.
5,613,505 A * 3/1997 Campbell et al. ..... 131/194
5,726,421 A 3/1998 Fleischhauer et al.
5,878,752 A 3/1999 Adams et al.
5,902,501 A * 5/1999 Nunnally et al. ..... 219/263
5,954,979 A 9/1999 Counts et al.
5,967,148 A 10/1999 Harris et al.
6,053,176 A 4/2000 Adams et al.
6,119,700 A 9/2000 Fleischhauer et al.
6,615,840 B1 * 9/2003 Fournier et al. ..... 131/194

* cited by examiner

*Primary Examiner*—Quang T. Van
(74) *Attorney, Agent, or Firm*—Burns, Doane, Swecker & Mathis, L.L.P.

(57) ABSTRACT

Inductive heating elements are provided with a specific configuration that results in a thermal wave that moves along a smoking device during a cleaning process, and control circuitry that maintains resonant conditions for maximum efficiency and power transfer during the thermal cleaning of the smoking device. A secondary can is positioned around electrical heater blades that contact the cigarette, and is configured to by preferentially heated by the induction of current within the can for the removal of condensates formed within the smoking device through extended periods of use.

20 Claims, 10 Drawing Sheets

INDUCTIVE CLEANING SYSTEM FOR REMOVING CONDENSATES FROM ELECTRONIC SMOKING SYSTEMS

TECHNICAL FIELD OF THE INVENTION

The present invention relates to methods and apparatuses for using, cleaning and maintaining electrically heated cigarette smoking systems.

BACKGROUND OF THE INVENTION

Commonly assigned U.S. Pat. Nos. 5,388,594; 5,505,214; 5,530,225; and 5,591,368 disclose various electrically powered smoking systems comprising cigarettes and electric lighters and are hereby expressly incorporated herein by reference.

The above-referenced smoking systems are designed with the intention of providing the smoker with all the pleasures of smoking while significantly reducing the side stream smoke produced during smoking. The smoking system also allows smokers the added benefit of reinitiating smoking of a cigarette that has been partially smoked, thereby providing the smoker with the ability to suspend and reinitiate smoking as desired.

In the operation of the smoking system, condensates may form and collect on the various parts of the heating fixture of the smoking device. The build up of condensates is undesirable as it affects the functionality of the smoking device and the flavor and overall pleasure a smoker of the device may have. Therefore, it is desirable to periodically clean the heating elements and other metallic components of the smoking device in order to remove the condensates that may have accumulated on the components.

Commonly assigned U.S. Pat. No. 6,119,700, discloses a cleaning system that is separate from the smoking device. The cleaning system provides two embodiments for cleaning the condensates from the heating fixture. The first embodiment utilizes a brush that fits within the heating element and cleans the collected condensates. The second embodiment utilizes an aqueous solution that when flushed through the device cleans out the foreign condensates that have accumulated. In using this cleaning device the heating element must be removed from the smoking device which can be time consuming for the smoker.

U.S. Pat. No. 5,878,752, issued Mar. 9, 1999, hereby incorporated by reference, discloses an electrical lighter that has an internal sleeve, or "secondary can" or "secondary heater" which concentrically surrounds the cigarette heating fixture. The cigarette heater elements transfer heat primarily via conduction to the inner surface of the sleeve and indirectly from this heated inner surface primarily via convection and radiation to other component surfaces to volatilize condensates which are deposited thereon during smoking. However, activation of the heating elements may not fully clean the condensates located on other components within the device. A ceramic layer is deposited on the outer surface of the sleeve to electrically insulate a subsequently applied sleeve heating element from the metal sleeve except for an exposed negative contact. In an alternative embodiment, an induction coil for heating the sleeve is shown.

The use of non-conventional smoking devices is increasing. Therefore, it is desirable to provide a fast and efficient means for cleaning the devices of the condensates which accumulate during smoking, thus providing further convenience and enjoyment for the smoker.

SUMMARY OF THE INVENTION

The present invention provides methods and apparatus that utilize inductive heating to thermally clean condensates from the surface of the components located within a smoking device. The inductive heating process is performed using radio frequency excitation coils which are wound in a desired configuration around the components that are to be directly heated, with power being provided to the coils in a controlled manner that achieves resonant circuit conditions. In embodiments of the invention, the arrangement of the coils creates a thermal wave that travels along the components that are being thermally cleaned. The temperature of the heated components within the smoking device is controlled by a control system. The control system utilizes measured temperature information of the components and adjusts the power to the coils and/or the airflow within the smoking device to control the temperature.

In other embodiments of the invention, a unique cylindrical cannister, which is positioned around the heater blades of the smoking device, is utilized to localize heating regions within the smoking device. Further embodiments utilize a catalyst which aids in reducing the amount of condensates and particles in the residue created when a tobacco product is ignited within the smoking device.

BRIEF DESCRIPTION OF THE DRAWINGS

The invention will be understood by reading the following detailed description in conjunction with the drawings in which.

DETAILED DESCRIPTION OF THE PREFERRED EMBODIMENTS

Figure 1:
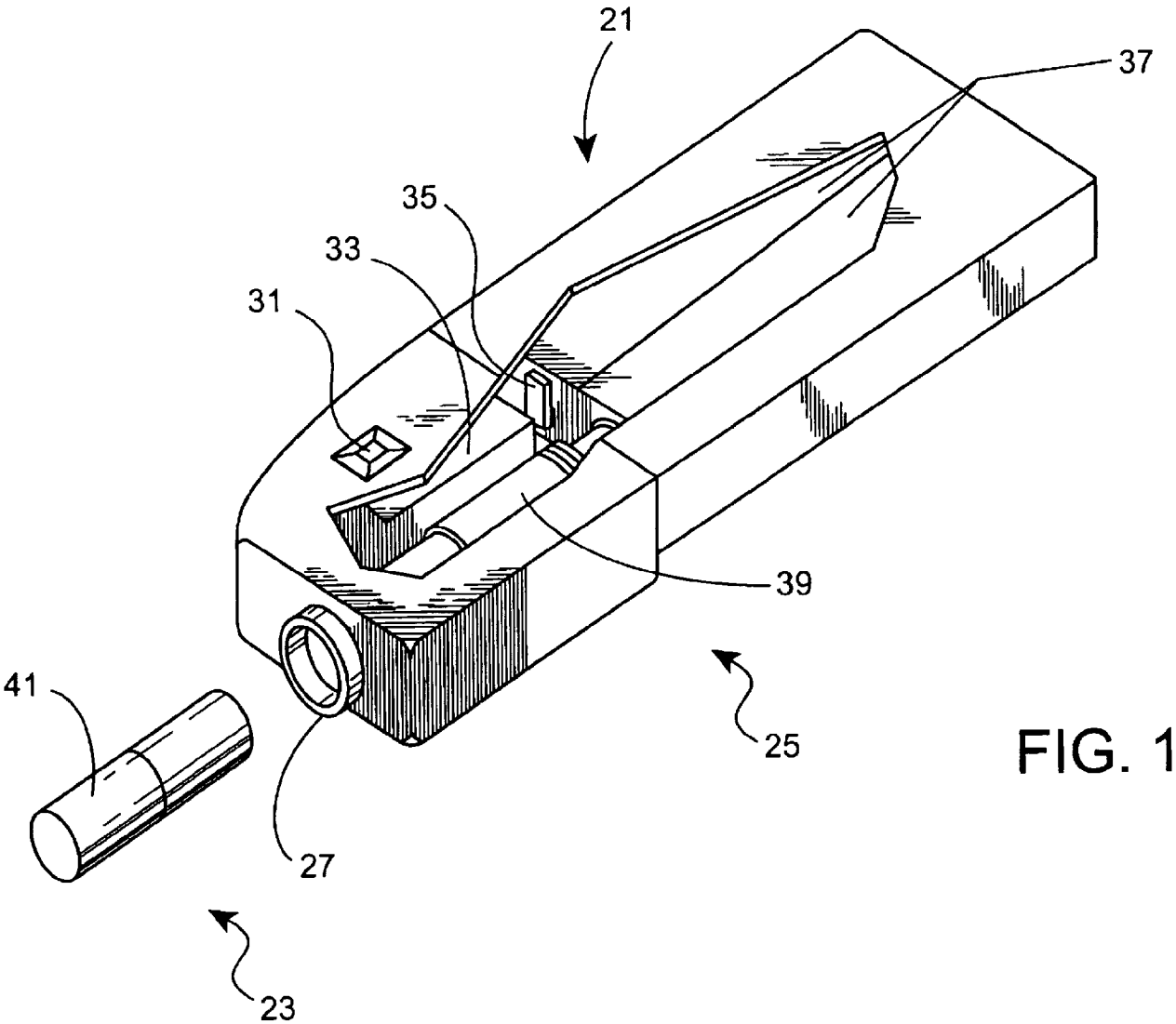
FIG. 1 is an exemplary electrically heated cigarette smoking device with which a cleaning system in accordance with the present invention may be utilized.

An electrically heated cigarette smoking system, in conjunction with which embodiments of the invention may be employed, is illustrated in FIG. 1. The smoking system 21 includes a cylindrical cigarette 23 and a reusable, hand held lighter 25. The cigarette 23 is adapted to be inserted in and removed from an opening 27 at the front end 29 of the lighter 25. The smoking system 21 is used in much the same way as a conventional cigarette. The smoker puffs on the cigarette end 41 that protrudes out from the opening 27, thereby obtaining the aroma and flavor associated with the smoke from the combustion of the cigarette 23. When the use of the cigarette 23 has been exhausted, the cigarette 23 is discarded.

The lighter 25 comprises a heating fixture 39, a power source 37, an electrical control circuitry 33, a puff sensor 35 and a display indicator 31. The heating fixture 39 contains the heating elements that ignite cigarette 23 when a puff is taken by the smoker. The control circuitry 33 controls the amount of power that is delivered to the heating elements of heating fixture 39 from power source 37. The puff sensor 35 can be a pressure sensitive device or a flow sensitive device that senses when a smoker draws on cigarette 23. The puff sensor can also be associated with internal manifolding or passageways within the lighter that ensure flow will only occur past the flow sensor when the smoker takes a puff on the cigarette, thereby eliminating false signals and improving response time. The puff sensor 35 then activates the appropriate heater blade located within the heating fixture 39, which pyrolizes the cigarette 23 or raises its temperature in the vicinity of the blade (referred to as the "heater footprint") sufficiently to produce volatile components that are subsequently condensed to form an aerosol that is inhaled by the smoker. The display indicator 31 may display the various information, such as, the number of puffs that remain, the power level, etc.

Figure 2:
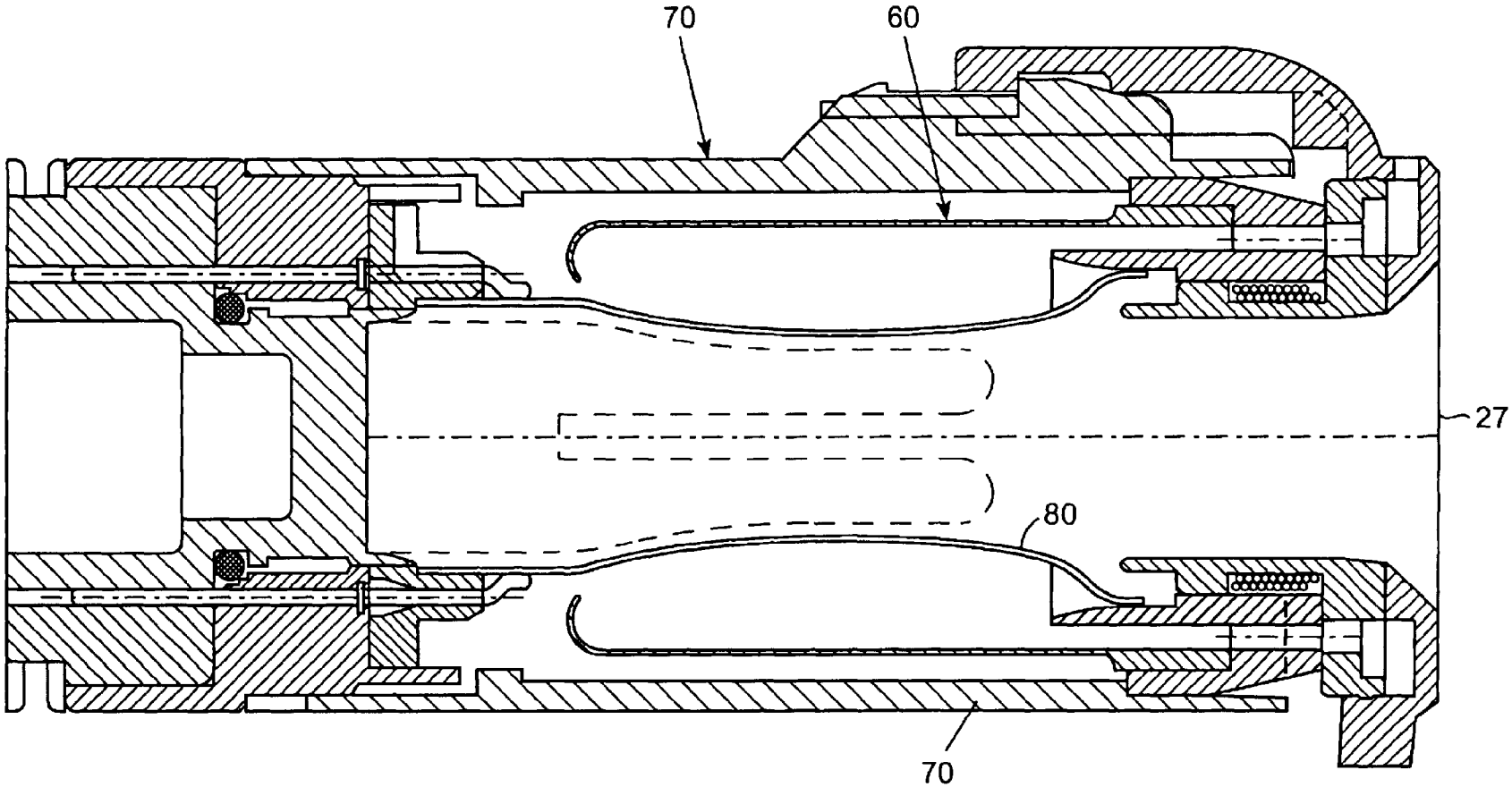
FIG. 2 is an exemplary illustration of an inductive cleaning system according to an embodiment of the invention.

A cross-sectional view of the heating element 39 is illustrated in FIG. 2. The heating element 39 includes at least an outer housing 70, heating blades 80, a secondary can 60 and an opening 27. Other features of the heating element 39 are discussed in commonly assigned U.S. Pat. Nos. 5,591,368 and 5,878,752, which are incorporated herein by reference. The heating blades 80 surround the cigarette when it is placed within the heating element 39. In one embodiment the heating element 39 is comprised of eight heating blades 80. However, different numbers of heating blades 80 may be used. The heating blades 80 are activated by the control circuitry 33 which controls which blades are heated, how hot and how long they are heated. The heated blades 60 ignite cigarette 23, which produces smoke and condensates.

The secondary can 60 (also referred to as a "secondary heater") surrounds the heating blades 80. The secondary can 60 acts to direct air flow, keep the outer housing from getting hot, and trap the condensates from attaching to other areas of the heating element 39 and smoking device 25. The secondary can 60 will accumulate a large portion of condensates released during the use of the smoking device 25 since it is arranged radially outward from the heating blades and in the path of condensates that are produced. Therefore, cleaning the condensates from the secondary can 60 may be necessary to allow the smoking device 25 to function as designed.

In one embodiment, the secondary can 60 is cleaned by inductive heating. The heat produced during the inductive heating of the secondary can 60 thoroughly cleanses the secondary can 60 of the condensates that are disposed thereon. Inductive heating is accomplished using a cleaning module that has radio frequency excitation coils which are wound in a desired configuration, and designed to fit around at least the portion of the electrically heated cigarette smoking system that includes the secondary can 60 or any other metallic components on which condensates may have accumulated. When an electrical current is run through the coils, electromagnetic forces are created which induce currents in the metallic secondary can 60 or other metallic components within the electrically heated cigarette. The induced currents circulate through the secondary can 60 or other target components, thereby heating the secondary can or other component sufficiently to volatilize or thermally release condensates on the can.

Figure 3:
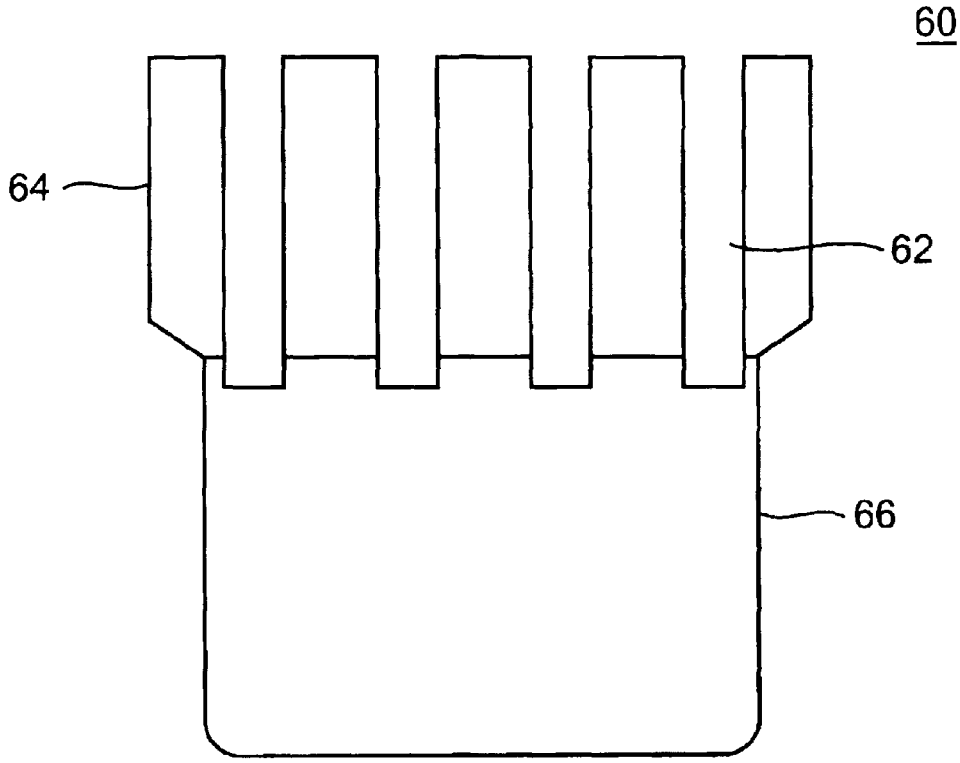
FIG. 3 is an exemplary illustration of a secondary can used in conjunction with an embodiment of the inductive cleaning system according to the invention.
Figure 4:
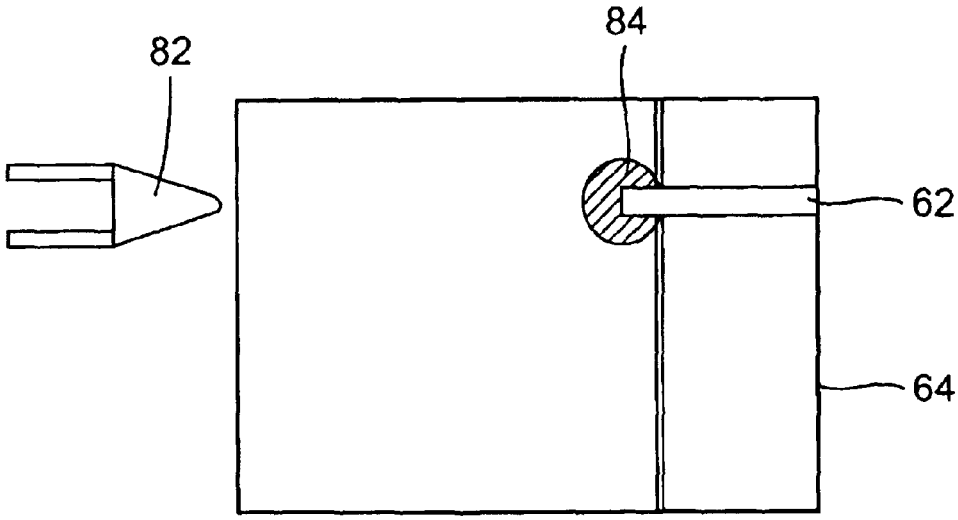
FIG. 4 is an exemplary illustration of a secondary can used in conjunction with an embodiment of the inductive cleaning system according to the invention and its localized heating arrangement.

Illustrated in FIG. 3 is an embodiment of the present invention in which the secondary can 60 of the electrically heated cigarette smoking system is designed in a manner that enables a desired control of the heating process. The secondary can 60 comprises a body 66, a mouthpiece 64 and slots 62. The mouthpiece end 64 is thicker than the body 66, which allows the mouthpiece 64 to stay cooler than the body 66. Thus, the intense heat generated during the cleaning process does not reach other components of the smoking device 25 that may be composed of low temperature material, such as plastic, etc. The slots 62 formed in the secondary can 60 are formed from the opening on the mouthpiece 64 to where the mouthpiece end 64 meets the body 66. These slots help prevent currents from circulating in the mouthpiece 64, thus reducing the inductive heating that occurs in the mouthpiece 64. Also, the configuration of the slots results in a preferential "crowding" of currents or eddy currents at the ends of the slots 62 where the slots 62 meet the body 66, which creates areas of intense localized heat during inductive heating. The slots 62 are made to coincide with the tips of the heating blades. The heater tips 82 are located directly below the area of intense localized heat. This process aids in the thorough cleaning of the heater tips 82. FIG. 4 illustrates the heater tip 82 lined up with the slot 62 of the secondary can 60.

Figure 5:
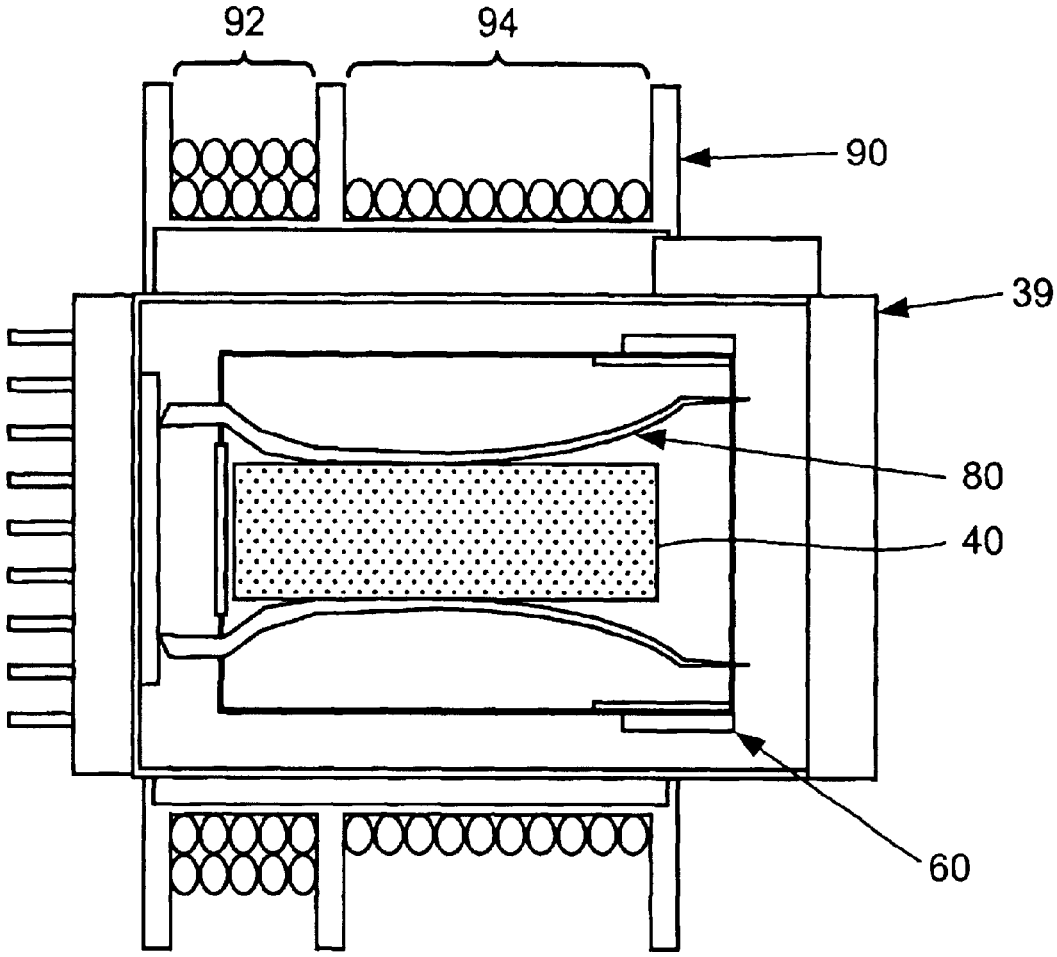
FIG. 5 is an exemplary illustration of an inductive coil arrangement used in an embodiment of the cleaning system according to the invention.
Figure 6:
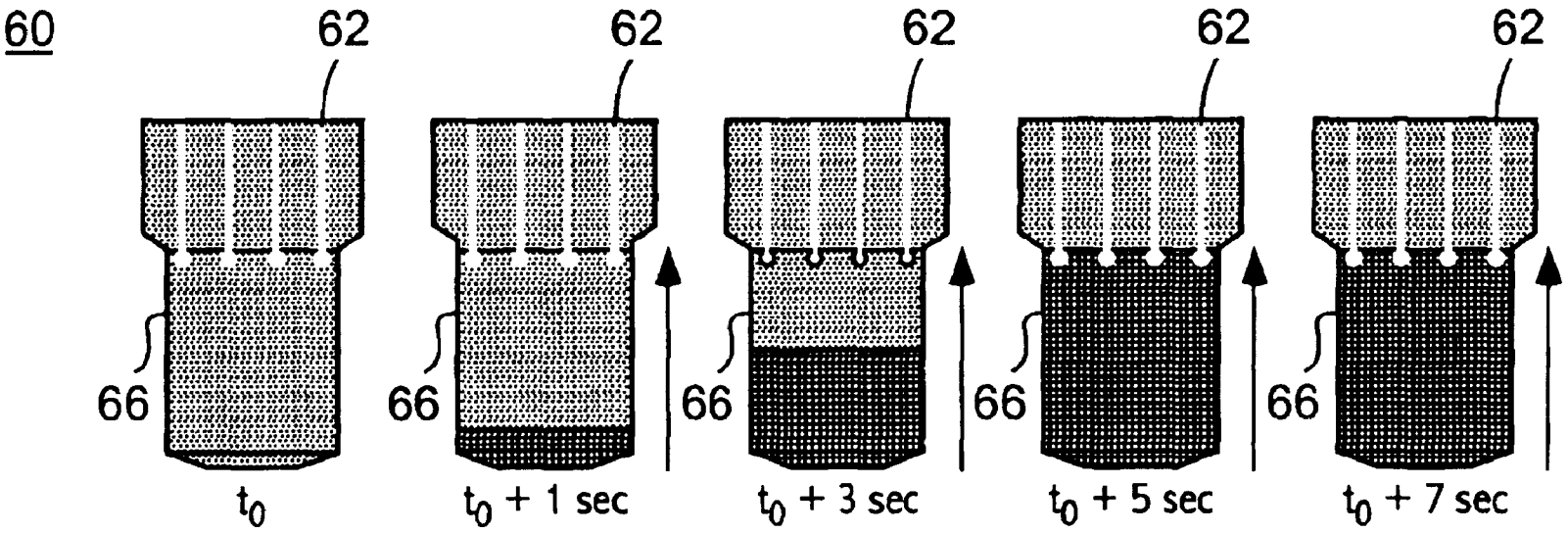
FIG. 6 is an exemplary illustration of a heating process of a secondary can being subjected to cleaning by an embodiment of the invention.
Figure 7:
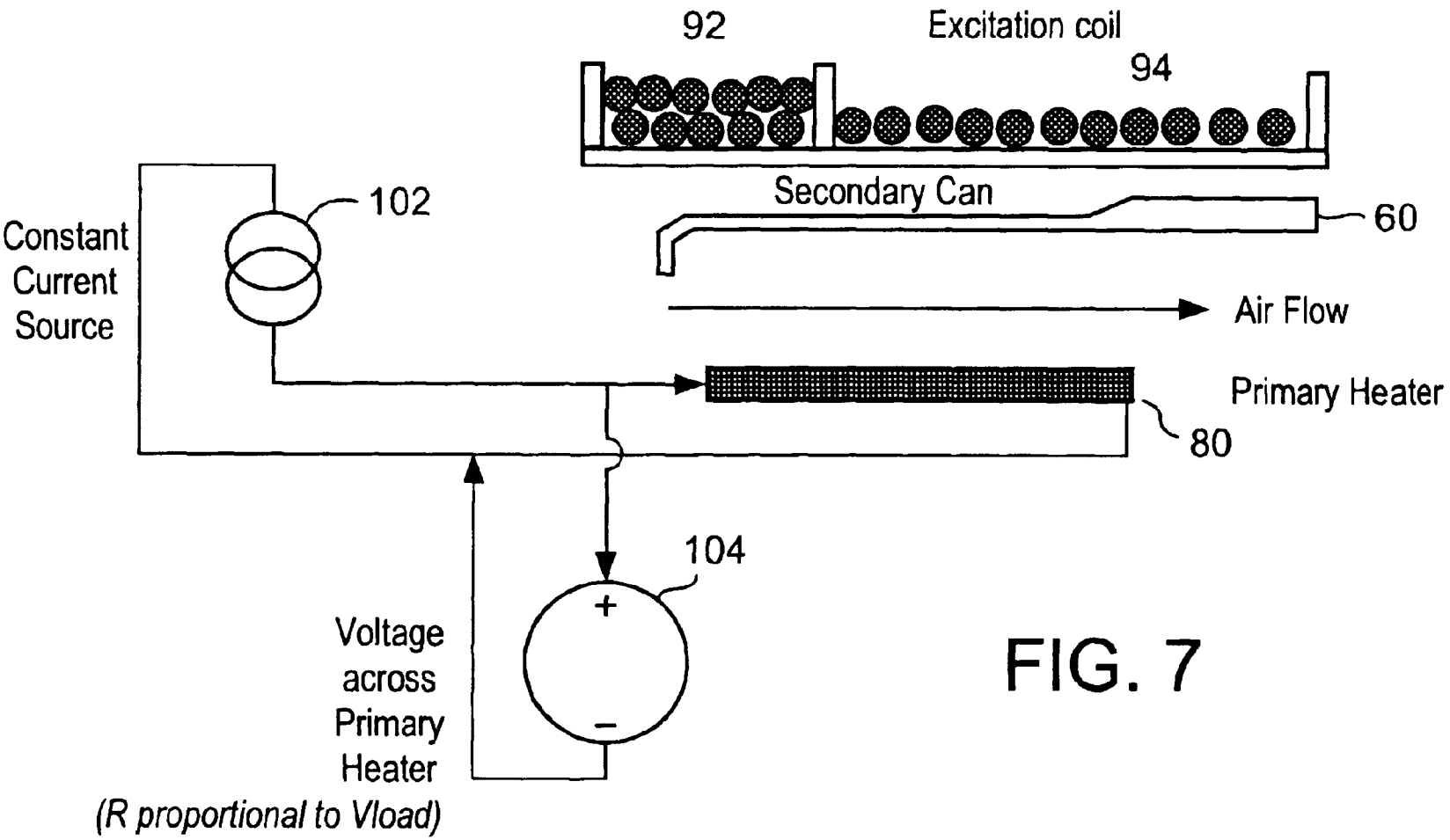
FIG. 7 is an exemplary illustration of a power circuitry used in an embodiment of the invention.

FIG. 5 illustrates a coil configuration 92, 94 in a cleaning module according to the invention as it relates to the inductively heated secondary can 60. The first part of the coil configuration 92 comprises two layers of coils. In a preferred embodiment of the invention the coils in this first part can include 10 turns, 5 on the bottom and 5 on the top. The second part of the coil configuration 94 can include one layer of 10 turns. Variations in the number of coil turns and layers may be implemented. For example, FIG. 7 illustrates another preferred embodiment, which preferably includes two layers of coils with 11 turns, 5 on the bottom and 6 on the top, in the first part and one layer of 11 turns in the second part of the coil. The coil configuration of FIG. 5 is structured to create a controlled heating of the secondary can 60 or other metallic components of an electrically heated cigarette smoking system. The first part of the coil configuration 92 creates a greater magnetic field, which results in a higher inductance. This creates more current activity in that section of the secondary can 60, which causes this section to heat rapidly. The second part of the coil configuration produces a lower inductance and thus the section of the secondary can 60 which coincides with the second coil configuration 94 does not heat as fast. Therefore, this controlled heating produces a thermal wave that travels along the secondary can 60, as illustrated in FIG. 6. This wave thermally treats and removes any remaining residue or condensates in the secondary can 60 as it moves down the secondary can 60.

As illustrated in FIG. 6, the thermal heating of the secondary can 60 begins at the bottom of the secondary can 60, which is the position furthest away from the mouthpiece 64. The arrows point in the direction of propagation of the thermal wave. From FIG. 6 it can be seen how the thermal wave makes it way down the secondary can 60. When heating first begins at $t_0$+1, only the bottom section is heated. At $t_0$+3, heating has moved up to the midpoint of the body 66 of the secondary can 60. Also, at this time the localized heating around the ends of the slots 62 has commenced. By $t_0$+5, the entire body 66 of the secondary can 60 is almost heated. At $t_0$+7, the entire body 66 is heated completing the thermal wave that propagates over the secondary can 60.

In cleaning the secondary can 60 of the smoking system 25, the temperature of the secondary can 60 can reach upwards of 700–800° C. or more. Therefore, by monitoring the temperature of the secondary can 60 the amount of energy introduced in the inductive heating coils, i.e. RF excitation power, can be controlled. The amount of energy introduced in the coils controls the amount of induced currents in the secondary can 60 and ultimately the temperature of the secondary can 60.

One embodiment of the present invention controls the thermal heating of the secondary can 60 by monitoring the variation in resistance of the one or more heating blades 80 that are positioned radially inward from the secondary can 60. This is accomplished by supplying a constant current 102 through one or more heating blades 80. The voltage 104 measured across the heating blades 80 is proportional to the resistance. Therefore, the resistance can be easily measured by measuring the voltage. The resistance is measured because as temperatures change, the resistance changes. The temperature coefficient of resistance (TCR) for the material being measured is known prior to measurement. In the case of the heater blades 60 comprising iron-aluminide, the TCR is approximately +20% from room temperature to 700° C. Therefore, if the heating blade 60 has a resistance of 1.0 ohm at room temperature (20° C.) it will have a resistance of 1.2 ohms at 700° C.

The resistance sensing for the heater blades can be performed by monitoring one or more primary cigarette heater blades through the heater base by means of a heater socket that the smoker would mate with the heater when the cleaning operation is performed.

Since the temperature of the heater blades 80 is induced by the induction heating of the secondary can 60, a control correlation can be developed between the resistance shift detected and the temperature of the secondary can 60. The temperature of the secondary can 60 and heater blades 80 will change as air flow through the system changes. Thus, a relative gauging of the temperature of the secondary can 60 may be easily accomplished.

In one embodiment of the present invention, the smoking system utilizes a catalyst through which the residue from the ignited cigarette is passed. The catalyst acts like a filter converting the smoke and residue into cleaner air. The operation of this conversion is best performed when the catalyst has been heated. To heat the catalyst, inductive heating methods, similar to those described above, may be used. Other forms of heating may also be used, for example, resistive heating. A catalyst pellet 40 within a coaxial tube can be placed inside the cigarette heater assembly, located centrally within the heater blades 80. This additional tube is coaxially heated by the secondary can 60, which is being heated inductively by excitation coils 92, 94. By controlling the mass and geometric placement of the catalyst axially within the secondary can, the heating rate of the catalyst, and hence catalyst performance can be controlled. Coaxial heating of the catalyst by the secondary can may allow elimination of a separate catalyst inductive heating work coil for the catalyst, which would eliminate supporting circuitry and drive electronics and reduce cleaner costs significantly. In an alternative embodiment, the catalyst pellet 40 can be replaced with just a coaxial tube positioned centrally within and in contact with the heater blades 80. This arrangement would allow for the central coaxial tube to be inductively heated by the secondary can 60, with the heated tube providing a means for internally thermally drying the cigarette heater after a liquid washing operation.

Figure 8:
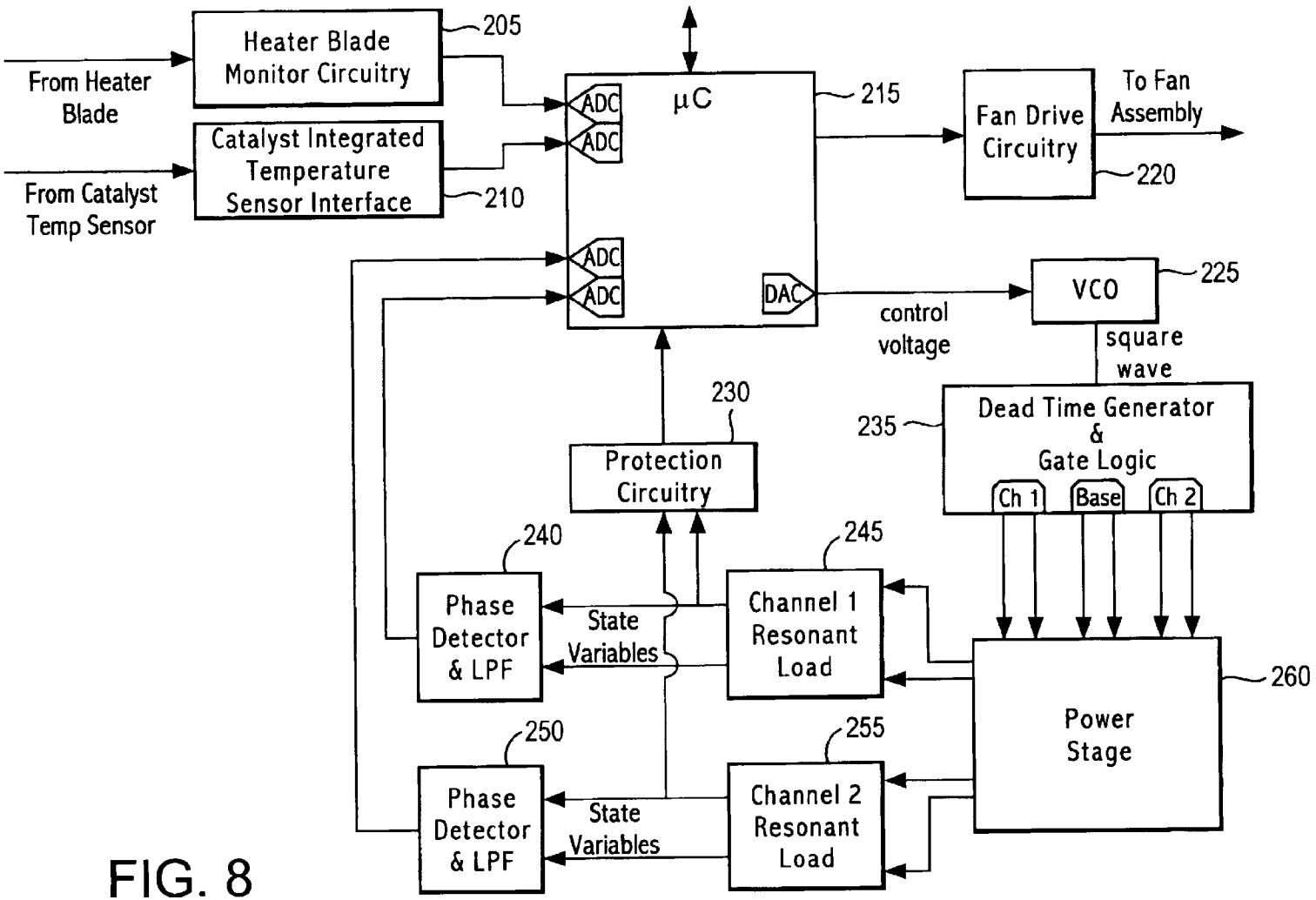
FIG. 8 is an exemplary illustration of a control system used in an embodiment of the invention.

In the use of the smoking system 25, a control system may be necessary to control the operation of the various components of the cleaning system. In one embodiment of the present invention, a control system 200, as shown in FIG. 8, is provided for such a purpose. The control system 200 may control the cleaning process of both the catalyst and the cigarette heater assembly. The microcontroller 215 receives temperature information from the heater blades by way of the heater blade monitor circuitry 205 and the temperature of the catalyst by way of the catalyst temperature sensor interface 210. The temperature of the heater blades can be measured by way of the thermal TCR methods described above or other methods that accurately measure the temperature of the heater blades. The catalyst temperature may be measured by way of an iron-aluminide thermal heat sensor. However, different methods of measuring temperature may be employed. Using the temperature information, the microprocessor 215 controls the fan drive circuitry 220. The fan drive circuitry 220 drives a fan that controls the air flow around the heating assembly and also aids in removing the residuals from the elements being thermally cleaned. The microprocessor 215 may determine that the elements being cleaned are too hot at which point the microprocessor 215 provides this information to the fan drive circuitry 220 to drive the fan which cools these elements.

Along with the temperature information received from the heater blade monitor circuitry 205 and catalyst temperature sensor interface 210, the microcontroller 215 also receives information from a set of phase detectors and low pass filters 240, 250. The phase detectors and low pass filters 240, 250 provide the microcontroller 215 with information that enables the microcontroller 215 to maintain efficiency and power transfer to the secondary can and catalyst thermal loads of the heating cleaning system. The phase detectors monitor the phase relationship between the excitation voltage and current on the resonant loads 245, 255.

To provide the microcontroller 215 with the necessary power information, a voltage controlled oscillator (VCO) 225 is used to maintain resonant circuit conditions, which in turn maximizes efficiency and power transfer to the excitation coils and hence to the secondary can, and if present, catalyst thermal loads. In other words, the VCO 225 autotunes the power circuitry. The VCO 225 is controlled to cause the phase shift between the excitation voltage and current to become zero. In order for this to be accomplished, the microprocessor 215 uses the output of the phase detectors 240, 250 in order to generate an adjusted voltage that is used by the VCO 225. The VCO 225 then supplies its output to the dead time generator and gate logic 235. The dead time generator and gate logic 235 is used to drive the FET power bridges. The power flow is independently controlled in heating of the catalyst and the secondary can. This is accomplished by using time domain multiplexing (TDM) of the power flow. The information from the dead time generator and gate logic 235 is supplied to the power stage 260 where it is adjusted for the different loads 245, 255. To protect the power stage 260, a protection circuitry 230 is provided. The protection circuitry 230 protects the power stage from a possible overload caused by for example, lack of temperature feedback or in the event the heater assembly has been removed.

The design of the control system 200 allows the control system to provide precise, repeatable, efficient heating of the secondary can and catalyst. It also allows for the individual control of the power to each of the heating devices used to thermally clean the secondary can and catalyst. Further, the versatility of the control system 200 allows it to control the temperature of the heated secondary can and catalyst by monitoring the heat rise of the secondary can and catalyst and by controlling the fan.

Figure 9A:
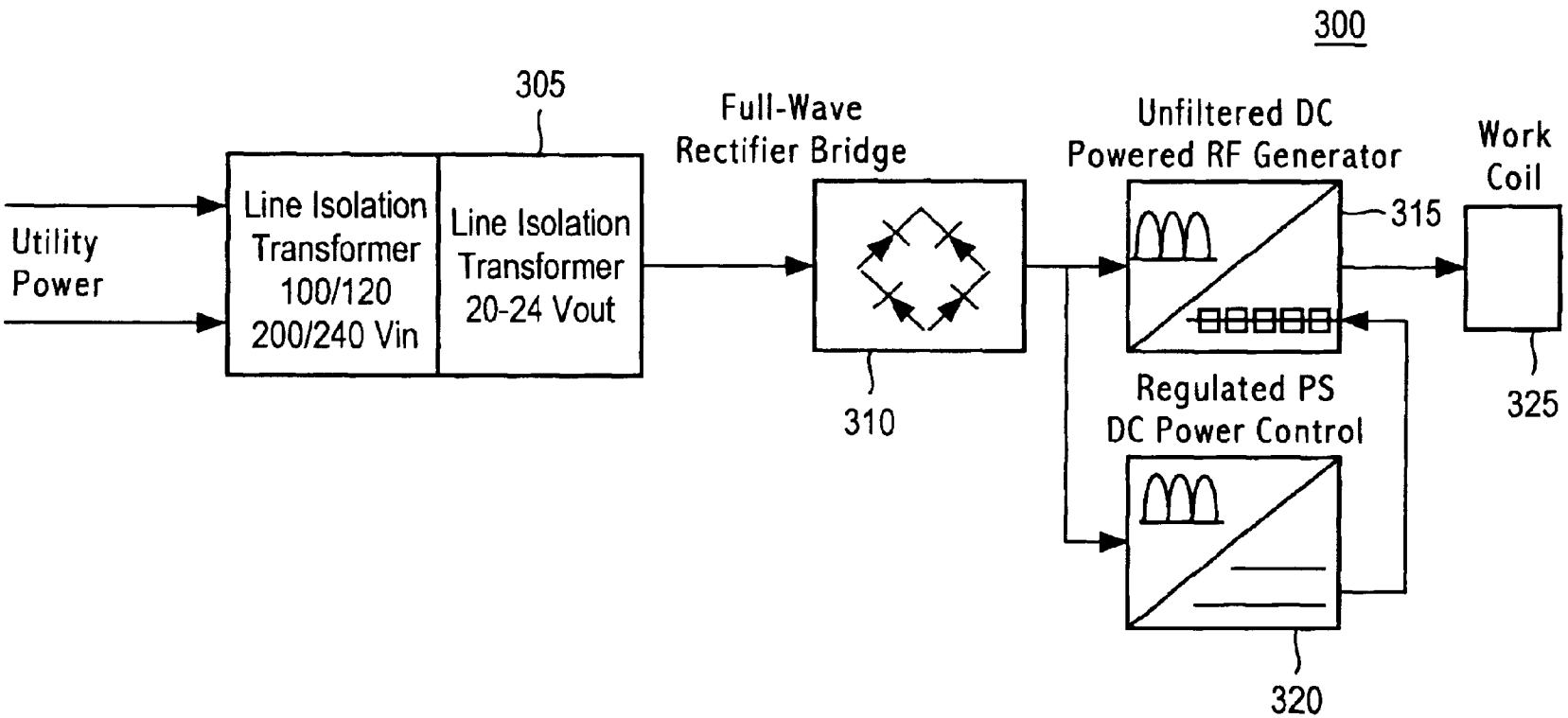
FIG. 9*a* is an exemplary illustration of a power supply used with an embodiment of the invention.
Figure 9B:
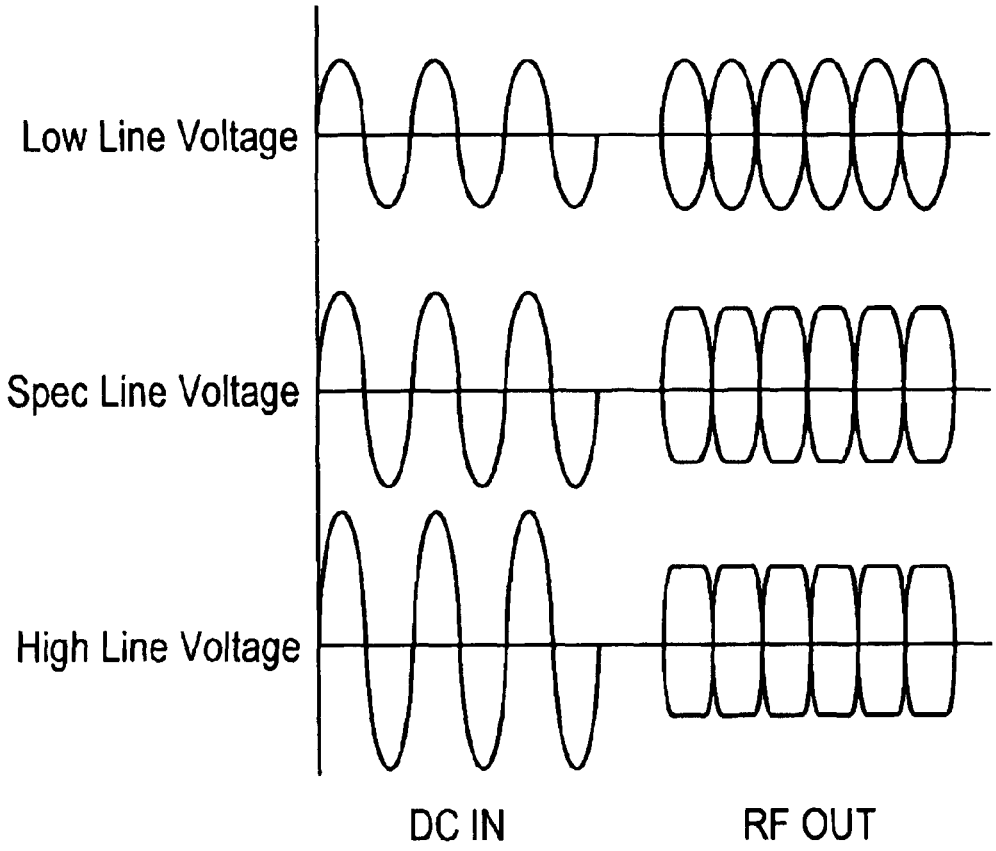
FIG. 9*b* is an exemplary illustration of power modulations generated by an embodiment of the invention.
Figure 10:
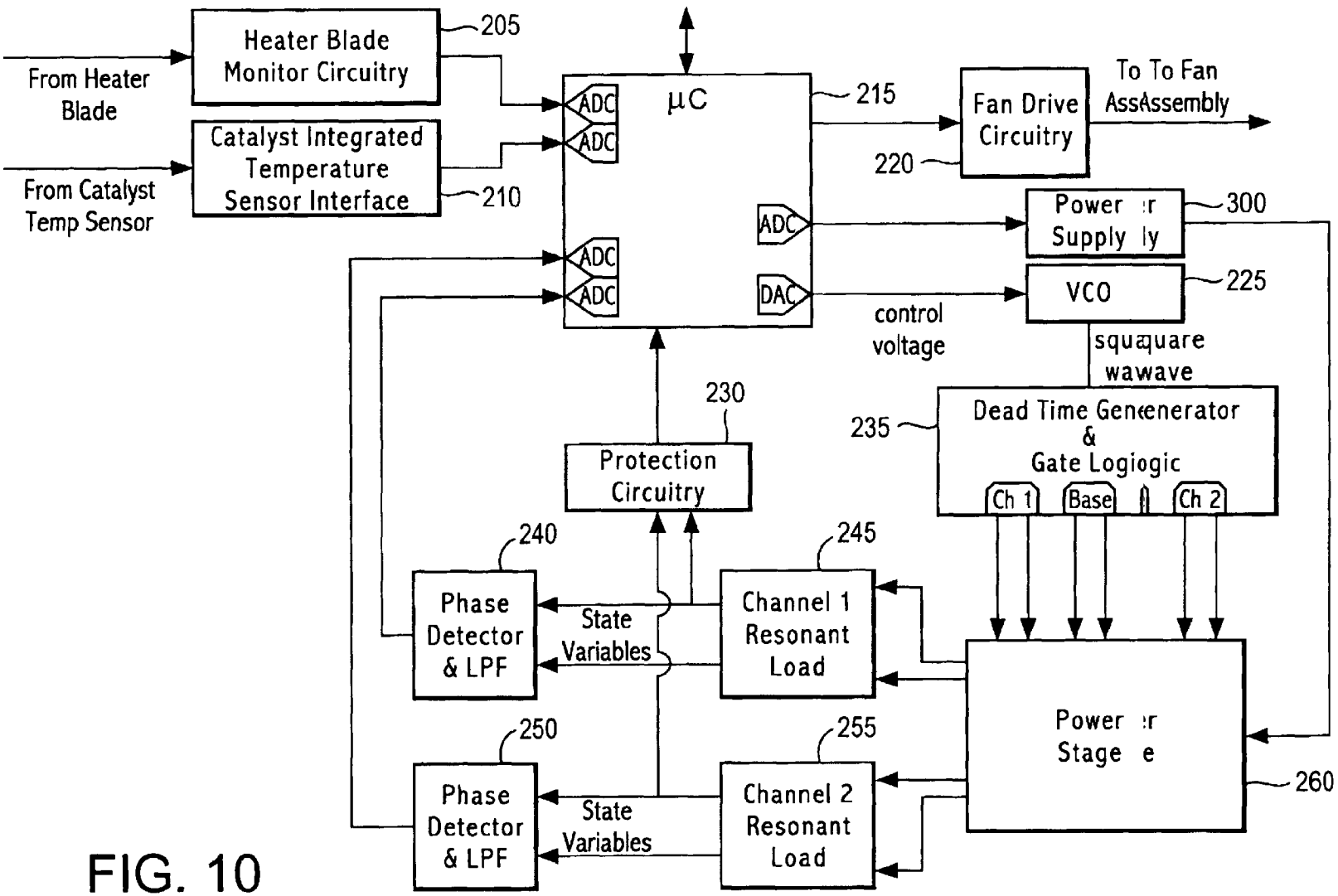
FIG. 10 is an exemplary illustration of a control system with a power supply used with an embodiment of the invention.

In another embodiment of the present invention there is provided a power supply used in connection with the inductive cleaning process. As shown in FIG. 9*a*, the power from the utility power is sent through an isolation transformer 305. The isolation transformer transforms the input voltage to an output voltage of between 20 and 24 volts. The signal is then sent to a bridge rectifier 310 which rectifies the signal. The signal is then sent to an RF generator 315 and a DC power control 320. The rectification of the signal allows the RF generator 315 to be modulated so that it maintains effectively constant power to the load 325 (i.e. work coil) without the need of filter capacitors or regulation of the DC input. It also allows the RF generator 315 to maintain its performance with variations of low or high voltage line power. FIG. 9*b* illustrates the output power of low and high line voltage in relation to the specified line voltage used in the system. FIG. 10 illustrates an exemplary embodiment in which the power supply 300 is connected to the control system. In FIG. 10, the output of the power supply 300 is provided to the micro-controller 215. The micro-controller 215 uses the information provided by the power supply 300, along with other information it has received, in its control over the voltage supplied to the loads 245, 255, through the power stage 260.

While this invention has been described in conjunction with the exemplary embodiments outlined above, many alternatives, modifications and variations will be apparent to those skilled in the art. Accordingly, the exemplary embodiments of the invention may be made without departing from the spirit and scope of the invention.

What we claim is:

1. A method of removing condensates within an electrically heated cigarette smoking device, the condensates being formed during the process of heating a tobacco product located within the smoking device during the smoking process, the method comprising the steps of:

thermally cleaning the smoking device by inductively heating the metallic components of the device to which the condensates are attached;

controlling the inductive energy supplied to the metallic components such that the amount of inductive energy supplied to the components varies at different positions along the smoking device;

controlling the temperature of the metallic components; and removing any debris that may be left from the thermal cleaning.

2. The method of claim 1, wherein the inductive heating is performed using radio frequency excitation coils that induce currents through a metallic component which causes the metallic component to increase in temperature.

3. The method of claim 1, wherein the metallic components include a cylindrical cannister located within the smoking device.

4. The method of claim 3, wherein the cylindrical cannister is heated by a thermal wave that travels along the cannister and is created by the arrangement of excitation coils used to inductively heat the cylindrical cannister.

5. The method of claim 4, wherein the excitation coils are arranged in two sections, the first section comprising two layers of coils, the first layer having 5 turns and the second layer having 6 turns, and the second section comprising one layer of 10 turns.

6. The method of claim 3, wherein the cylindrical cannister is designed with removed sections, which keeps intense heat away from a mouthpiece end of the smoking device and provides intense localized areas of heat at the points in the cylindrical cannister that correspond to the position of heater tips located in the smoking device.

7. The method of claim 1, wherein the temperature of the metallic components is determined by measuring the change in resistance of heater blades located within the smoking device.

8. The method of claim 1, wherein the step of controlling the temperature comprises a control system which utilizes information received from measured temperatures to control temperatures within the smoking device by determining the power distribution to the excitation coils and airflow within the smoking device.

9. The method of claim 1, wherein the inductively heated component comprises a catalyst which acts to clean the condensates from the air within the smoking device.

10. An apparatus for removing condensates accumulated on metallic components within an electrically heated cigarette smoking device formed during the process of heating a tobacco product located within the smoking device during the smoking process, the apparatus comprising:

an inductive heating element that heats the components within the smoking device in the process of thermally cleaning the components;

a control system that controls the temperature of the heated components; and a fan that circulates air through the smoking device;

wherein the inductive heating element is arranged to induce different amounts of inductive energy at different sections of the heated components.

11. The apparatus of claim 10, wherein the inductive heating element uses radio frequency excitation coils that induce currents through the heated components which causes the heated components to increase in temperature.

12. The apparatus of claim 10, wherein the heated components include a cylindrical cannister located within the smoking device.

13. The apparatus of claim 12, wherein the cylindrical cannister is heated by a thermal wave that travels along the cannister and is created by the arrangement of excitation coils used to inductively heat the cylindrical cannister.

14. The apparatus of claim 13, wherein the excitation coils are arranged in two sections, the first section comprising two layers of coils, the first layer having 5 turns and the second layer having 6 turns and the second section having one layer of 10 turns.

15. The apparatus of claim 12, wherein the cylindrical cannister is designed with removed sections closer to a mouthpiece end of the smoking device to keep intense heat away from the mouthpiece end of the smoking device and to provide intense localized areas of heat at points in the cylindrical cannister that correspond to the position of heater tips located in the smoking device.

16. The apparatus of claim 10, wherein the temperature of the heated environment is determined by measuring the change in resistance of heater blades located within the smoking device.

17. The apparatus of claim 10, wherein the step of controlling the temperature comprises a control system which utilizes information received from measured temperatures to control temperatures within the smoking device by determining the power distribution to the excitation coils and airflow within the smoking device.

18. The apparatus of claim 10, further comprising a catalyst which acts to clean the condensates from the air within the smoking device.

19. The apparatus of claim 10, wherein the control system comprises power circuitry including a voltage controlled oscillator that maintains resonant circuit conditions in the power circuitry providing power to the inductive heating element to maximize efficiency and power transfer to the inductive heating element.

20. The apparatus of claim 19, wherein the inductive heating element comprises radio frequency excitation coils having different numbers of coils corresponding to the different sections of the heated components.

* * * * *